US011470907B2

(12) United States Patent
Beauchamp et al.

(10) Patent No.: US 11,470,907 B2
(45) **Date of Patent: *Oct. 18, 2022**

(54) ADJUSTABLE HELMET WITH SIDE PROTECTIVE MEMBERS

(71) Applicant: SPORT MASKA INC., Montreal (CA)

(72) Inventors: Pierre-Luc Beauchamp, Montréal (CA); Sebastien Morin, Brossard (CA); Simon Langlois, Notre-Dame-de-l'Île-Perrot (CA)

(73) Assignee: SPORT MASKA INC., Montreal (CA)

( * ) Notice: Subject to any disclaimer, the term of this patent is extended or adjusted under 35 U.S.C. 154(b) by 218 days.

This patent is subject to a terminal disclaimer.

(21) Appl. No.: 16/365,942

(22) Filed: Mar. 27, 2019

(65) Prior Publication Data

US 2020/0305539 A1 Oct. 1, 2020

Related U.S. Application Data

(63) Continuation of application No. 15/066,700, filed on Mar. 10, 2016, now Pat. No. 10,278,447.

(51) Int. Cl.
*A42B 3/32* (2006.01)
*A42B 3/12* (2006.01)

(52) U.S. Cl.
CPC ..... *A42B 3/324* (2013.01); *A42B 3/127* (2013.01)

(58) Field of Classification Search
CPC ..... A42B 3/324; A42B 3/127; A42B 3/12
See application file for complete search history.

(56) References Cited

U.S. PATENT DOCUMENTS 4,404,690 A 9/1983 Farquharson
4,477,929 A * 10/1984 Mattsson ..... A42B 3/324 2/417

(Continued)

FOREIGN PATENT DOCUMENTS

CA 2263384 6/1998
CA 2784316 10/2012

(Continued)

OTHER PUBLICATIONS

Reebok 11K Helmet. Images and product description accessible at http://www.totalhockey.com/product/11K_Helmet/itm/6471-2/, acessed on Feb. 23, 2016.

(Continued)

*Primary Examiner* — Katherine M Moran
(74) *Attorney, Agent, or Firm* — Norton Rose Fulbright Canada

(57) ABSTRACT

A protective helmet with first and second helmet sections each including an outer shell section and an inner layer section of protective material. The first and second helmet sections are displaceable relative to one another to adjust a size of the helmet. Two opposed side protective members are received inwardly of the outer shell sections on opposed sides of the helmet. Means for adjusting a position of the side protective members relative to the inner layer sections of protective material are provided. The means are configured such that, when the protective helmet is adjusted when on the head of the wearer, the protective members remain substantially stationary with respect to the head of the wearer when the inner layer sections are displaced with the first and second helmet sections.

11 Claims, 6 Drawing Sheets

(56) References Cited

U.S. PATENT DOCUMENTS

| | | | | |
|---|---|---|---|---|
| 5,659,900 | A | 8/1997 | Arney et al. | |
| 6,324,700 | B1 | 12/2001 | McDougall | |
| 6,385,780 | B1 | 5/2002 | Racine | |
| 6,453,476 | B1 | 9/2002 | Moore, III | |
| 7,954,178 | B2 | 6/2011 | Durocher et al. | |
| 8,095,995 | B2 | 1/2012 | Alexander et al. | |
| 8,182,909 | B2 | 5/2012 | Schneider et al. | |
| 8,348,448 | B2 | 1/2013 | Orozco et al. | |
| 8,875,318 | B2 | 11/2014 | Huh | |
| 9,642,409 | B2 * | 5/2017 | Roesler | A42B 1/08 |
| 10,278,447 | B2 * | 5/2019 | Beauchamp | F41H 1/04 |
| 2005/0015857 | A1 * | 1/2005 | Desjardins | A42B 3/324 2/417 |
| 2007/0157372 | A1 | 7/2007 | Musal et al. | |
| 2007/0266482 | A1 * | 11/2007 | Alexander | A42B 3/324 2/418 |
| 2008/0184463 | A1 * | 8/2008 | Sawabe | A42B 3/324 2/418 |
| 2011/0047679 | A1 * | 3/2011 | Rogers | A42B 3/324 2/414 |
| 2012/0036620 | A1 * | 2/2012 | Harris | A42B 3/127 2/414 |
| 2013/0000017 | A1 | 1/2013 | Szalkowski et al. | |
| 2013/0219595 | A1 | 8/2013 | Musal | |
| 2017/0164679 | A1 * | 6/2017 | Schmitter | A42B 3/326 |
| 2017/0258168 | A1 * | 9/2017 | Beauchamp | A42B 3/125 |

FOREIGN PATENT DOCUMENTS

| | | |
|---|---|---|
| CA | 2821540 | 10/2012 |
| CA | 2838103 | 10/2012 |
| CA | 2847669 | 10/2012 |
| CA | 2872140 | 10/2012 |
| CA | 2880069 | 10/2012 |
| WO | 2015089646 | 6/2015 |

OTHER PUBLICATIONS

Bauer 9900 Hockey Helmet. Images and product description accessible at http://www.thehockeyshop.com/bauer-9900-hockey-helmet.html, acessed on Feb. 23, 2016.

* cited by examiner

ADJUSTABLE HELMET WITH SIDE PROTECTIVE MEMBERS

CROSS-REFERENCE TO RELATED APPLICATIONS

This application is a continuation of U.S. application Ser. No. 15/066,700 filed Mar. 10, 2016, now issued as U.S. Pat. No. 10,278,447, the entire contents of which are incorporated by reference herein.

TECHNICAL FIELD

The application relates generally to protective helmets and, more particularly, to helmets that are adjustable in size.

BACKGROUND

Some protective helmets can be adjusted in size in order to fit onto heads of different sizes. As the helmet size increases or decreases, it is known to adjust the positioning of the internal padding of the helmet accordingly to provide protection for the head.

However, not all components of the internal padding of some conventional helmets can be properly positioned when the helmet is adjusted in size. Furthermore, some components of the internal padding of some conventional helmets will shift or be displaced when the helmet size is adjusted, thereby exposing the head to the rigid outer shell of the helmet via gaps in the internal padding. These encumbrances limit the comfort and protection provided by the helmet.

SUMMARY

In one aspect, there is provided a protective helmet, comprising: a shell including a first shell section and a second shell section, the shell defining an internal enclosure for receiving a head and the first and second shell sections being displaceable relative to one another to adjust a size of the internal enclosure; an inner layer of protective material having a first layer section mounted internally on the first shell section and a second layer section mounted internally on the second shell section, the first and second layer sections being displaceable with the respective first and second shell sections; and at least one protective member received within the shell and having a first end portion and an opposed second end portion, the first end portion extending between the first layer section and the first shell section, the second end portion extending between the second layer section and the second shell section, at least one of the first and second end portions of each protective member being displaceable relative to a corresponding one of the first and second layer sections upon the relative displacement of the first and second shell sections.

In another aspect, there is provided a protective helmet, comprising: first and second helmet sections each including an outer shell section having an inner layer section of protective material mounted thereto, the first and second helmet sections being displaceable relative to one another to adjust a size of the helmet; and two opposed side protective members received inwardly of the outer shell sections on opposed sides of the helmet, each side protective member having a first end portion and an opposed second end portion, the first end portion being connected to the first helmet section by a first connection and the second end portion being connected to the second helmet section by a second connection, at least one of the first and second connections being a sliding connection allowing relative movement between the side protective member and a corresponding one of the first and second helmet sections.

DESCRIPTION OF THE DRAWINGS

Reference is now made to the accompanying figures in which.

DETAILED DESCRIPTION

Figure 1A:
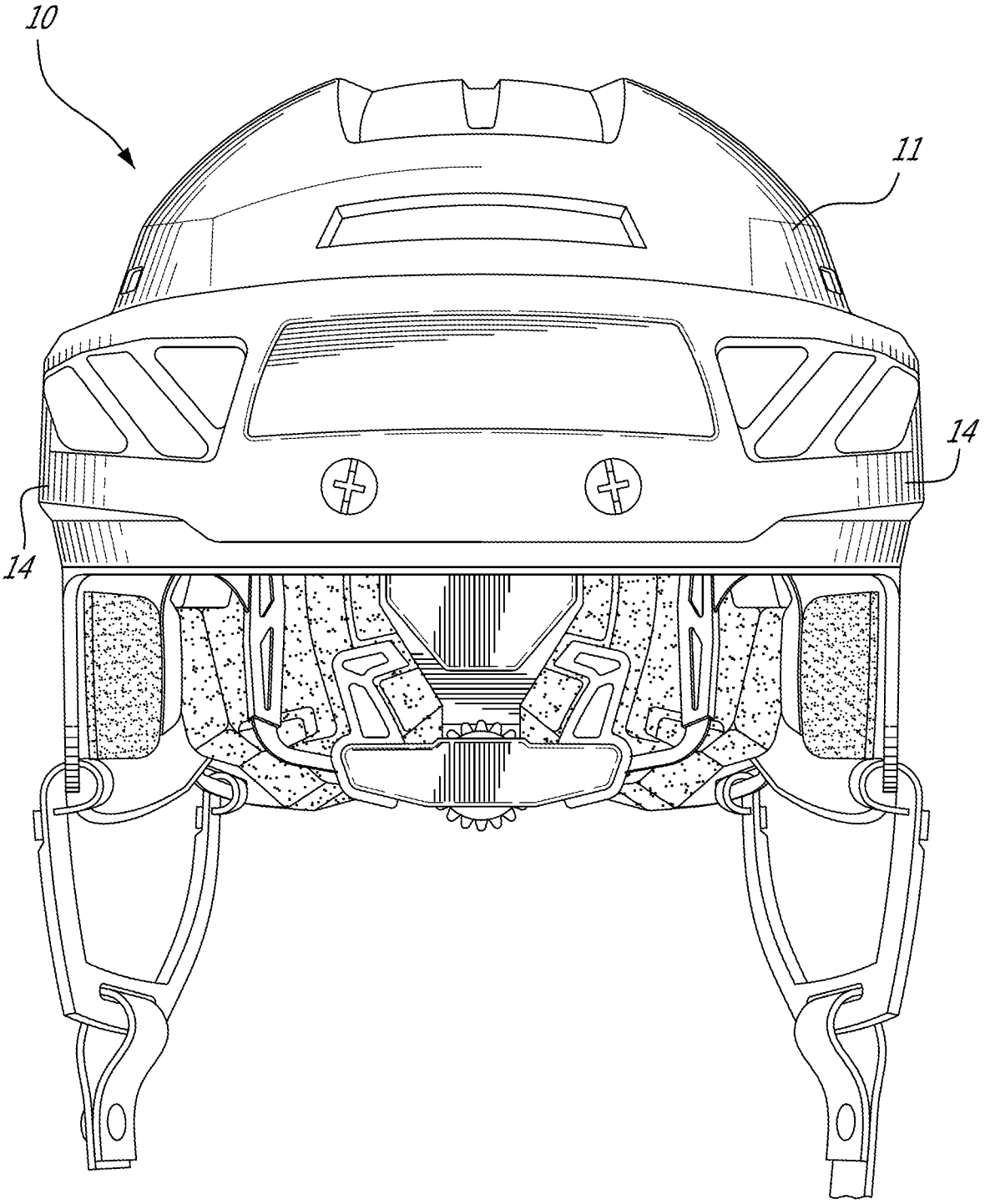
FIG. 1A is a schematic front view of a helmet having side protective members, according to an embodiment of the present disclosure.
Figure 1B:
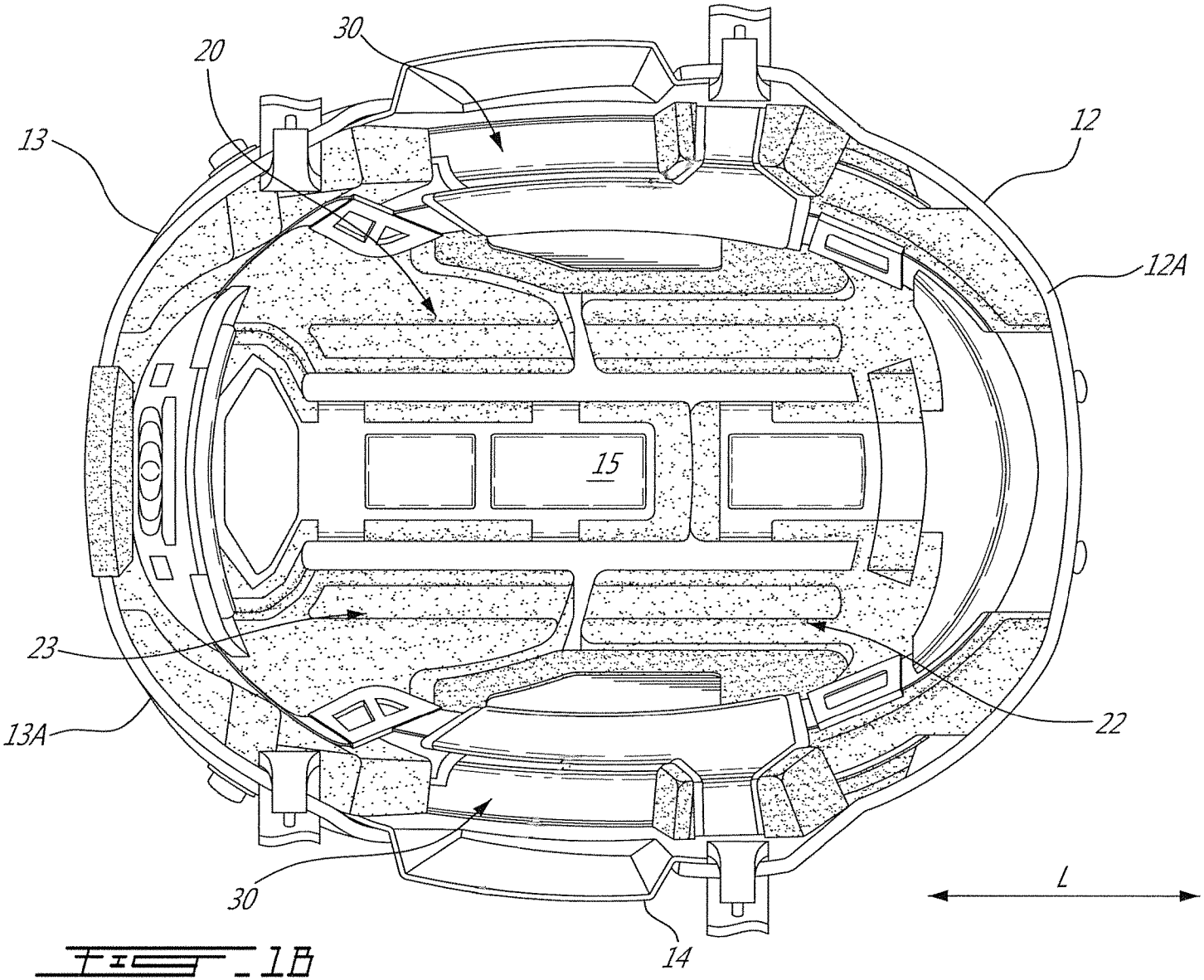
FIG. 1B is a schematic bottom view of an interior enclosure of the helmet as shown in FIG. 1A.

Referring to FIGS. 1A and 1B, a protective helmet is generally shown at 10. Although the helmet 10 is shown and described as a hockey helmet, it is understood that the helmet 10 can alternately be any other type of protective helmet 10, including but not limited to a lacrosse helmet, a baseball helmet, a football helmet, and a military helmet.

The helmet 10 includes a rigid outer shell 11 to protect a head of a wearer from impacts. Referring more particularly to FIG. 1B, in the embodiment shown, the helmet 10 has two helmet sections, each including an outer shell section and an inner layer section. More particularly, the shell 11 includes a front or first shell section 12, and a rear or second shell section 13. The first shell section 12 includes a front portion 12A configured to cover and protect a corresponding front portion of the head, including for example part of the forehead. Although not shown, the front portion 12A may also extend downwardly to cover part of the face, and include for example eye protection, such as a clear visor or mesh grid. The second shell section 13 includes a rear portion 13A configured to cover and protect a corresponding rear portion of the head. The first and second shell sections 12, 13 are engaged with one another to define two side portions 14 configured to cover and protect corresponding side portions of the head. In the embodiment shown, each side portion 14 includes a side flap which extends downwardly to protect an area of the side portion of the head between the temple and the ear. It is understood that other configurations for the helmet are also possible, including, but not limited to, a helmet including more than two sections.

The first and second shell sections 12, 13 define a protective internal enclosure 15 for the head of the wearer of the helmet 10. The internal enclosure 15 extends between, and is delimited by, the front portion 12A, the rear portion 13A, and the side portions 14 of the shell 11. More particularly, the internal enclosure 15 extends in a "front-back" or longitudinal direction L between the front portion 12A and the rear portion 13A, and extends in a lateral direction between the side portions 14.

The first and second shell sections 12, 13 are movably engaged to one another to allow a size of the helmet 10 to be adjusted. In the embodiment shown, the first and second shell sections 12, 13 are elements which are slidingly displaceable relative to one another along the longitudinal direction L, in a generally backward and forward direction, to increase and decrease the size of the internal enclosure 15. The first and second shell sections 12, 13 can be slidingly displaced between a first fully expanded position corresponding to a maximum size of the internal enclosure 15, and a second fully contracted position corresponding to a minimum size of the internal enclosure 15. It is understood that alternately, the shell sections 12, 13 may be relatively displaceable through any other suitable type of relative motion, including, but not limited to, pivoting motion, sliding motion along a different direction. The shell sections 12, 13 may be movable in entirety with respect to one another, for example be completely detachable from one another, or be relatively displaceable while having portions remaining in a fixed position with respect to one another, for example shell sections 12, 13 having top portions permanently or detachably interconnected by a hinge or hinge like connection, and relatively movable about that connection.

The helmet 10 has one or more securing members (not shown) configured and disposed to cooperate with the first and second shell sections 12, 13 to inhibit their movement relative to one another when the securing member is in a closed position. This allows a wearer of the helmet 10 to select the desired size. The sliding engagement between the first and second shell sections 12, 13 may include the second shell section 13 being disposed to slide over the outer surface of the first shell section 12. It is understood that the present disclosure encompasses the reverse configuration as well.

The first and second shell sections 12, 13 can be made of any type of adequate material, including but not limited to, fiber reinforced materials, thermoplastics, and a combination thereof. In a particular embodiment, the first and second shell sections 12, 13 are made of high density polyethylene (HDPE).

Still referring to FIG. 1B, the internal surfaces of the first and second shell sections 12, 13 are overlaid with an inner layer 20 of padding or protective material. The inner layer 20 has a first layer section 22 mounted internally to the first shell section 12, and a second layer section 23 mounted internally to the second shell section 13. In a particular embodiment, the inner layer sections 22, 23 are connected to the internal surface of the respective shell sections 12, 13 using a suitable adhesive; other suitable type of attachments may alternately be used, including, but not limited to, suitable mechanical fasteners. Each layer section 22, 23 covers at least a portion of the internal surface of its respective shell section 12, 13 with the protective material. Each of the first and second layer sections 22, 23 may be provided as one piece of protective material, or as a plurality of complementary pieces.

The layer sections 22, 23 are movable with the shell sections 12, 13 when the size of the internal enclosure 15 of the helmet 10 is adjusted. The first and second layer sections 22, 23 do not undergo relative movement with their corresponding first and second shell section 12, 13. Instead, the first layer section 22 is displaced with the first shell section 12, and the second layer section 23 is displaced with the second shell section 13, when the shell sections 12, 13 are relatively displaced to adjust the size of the internal enclosure 15.

The layer sections 22, 23 can be made of any type of appropriate material, including but not limited to expanded foam such as for example expanded polypropylene (EPP), expanded polyethylene (EPE) or expanded polystyrene (EPS); fabric; any other adequate polymer; or any other material that may serve to absorb and/or limit the effects of a force applied on the helmet 10 and/or provide comfort to the wearer.

The helmet 10 also includes two side protective members 30, which in a particular embodiment include or are completely made of foam; other materials may alternately be used. Each side protective member 30 is positioned adjacent to an inner surface of each side portion 14 to provide padding to a corresponding side portion of the head. Each side protective member 30 thus faces the internal enclosure 15 for engagement with the side of the wearer's head. In the embodiment shown, each side protective member 30 is positioned along each side portion 14 to fill a gap between the protective material of the first and second layer sections 22, 23. More particularly, each side protective member 30 may be located such as to overlay a respective portion of the side of the head of the wearer.

Each side protective member 30 is displaceable relative to the inner layer 20. In a particular embodiment, and as will be explained in greater detail below, this relative movement between the side protective members 30 and the inner layer 20 contributes to the side protective members 30 remaining substantially unmoved or stationary with respect to the head of the wearer when the layer sections 22, 23 of the inner layer 20 are displaced with the shell sections 12, 13 when the size of the helmet 10 is adjusted. The position of the side protective members 30 relative to the portion of the head which they are intended to protect therefore does not experience any significant change. This allows the side protective members 30 to remain in a fixed position relative to the portion of the head for which they provide protection, irrespective of the size of the internal enclosure 15. In a particular embodiment, each side protective member 30 remains centered or substantially centered within the gap in the protective material of the layer sections 22, 23 as the size of the helmet 10 is adjusted.

Figure 2A:
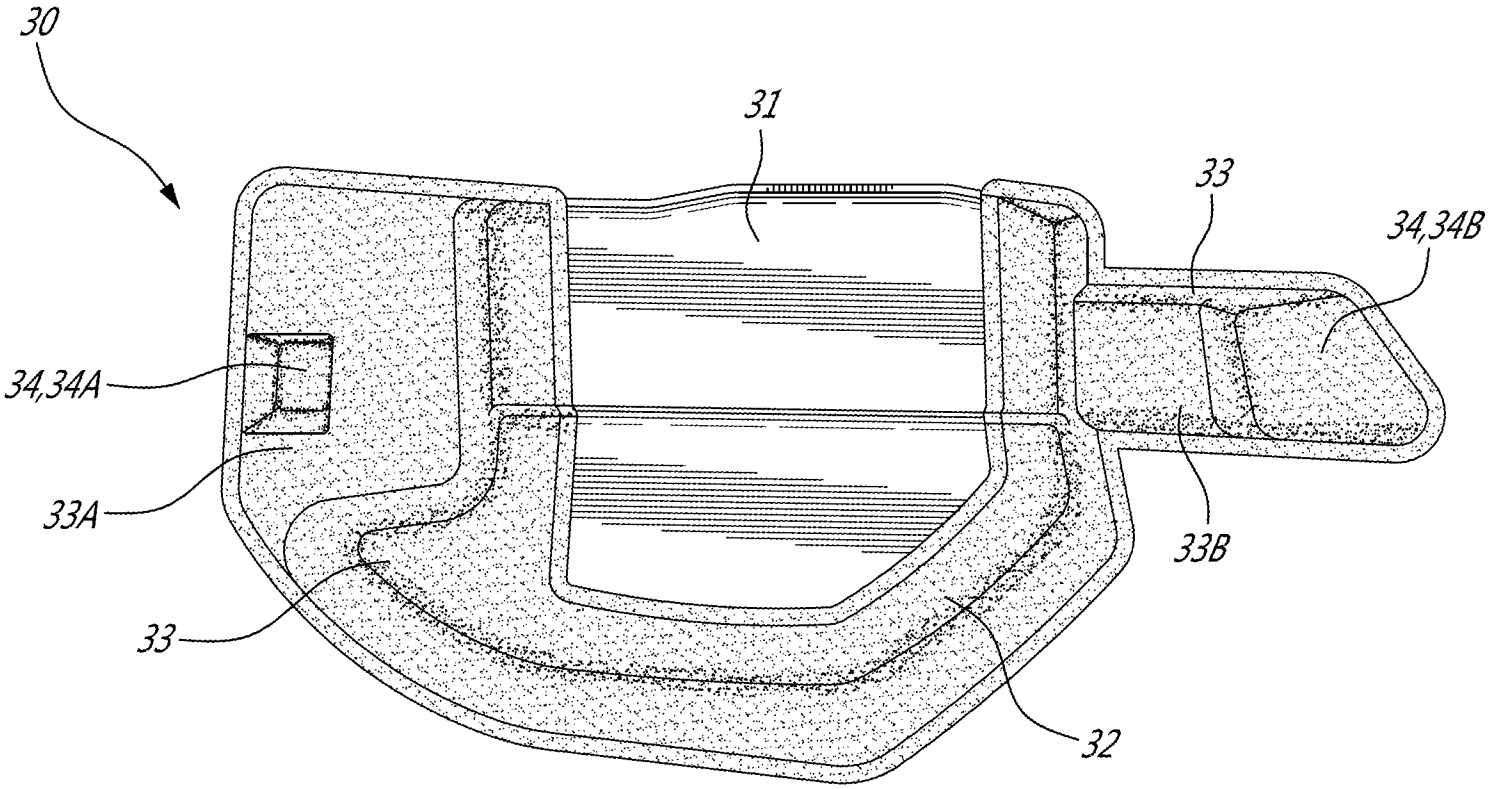
FIG. 2A is a schematic side view of one of the side protective members of the helmet of FIG. 1A.
Figure 2C:
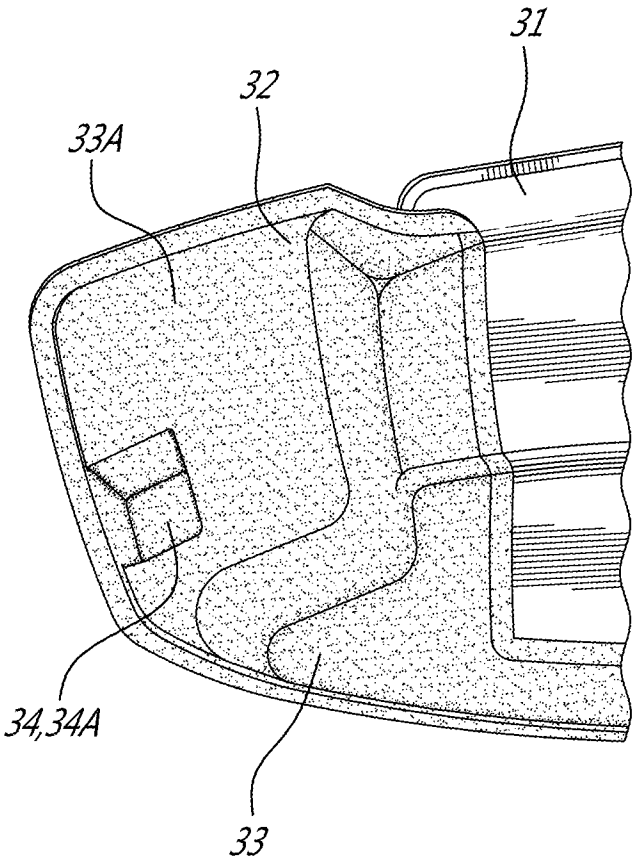
FIG. 2C is schematic tridimensional view of another end portion of the side protective member of FIG. 2A.
Figure 2B:
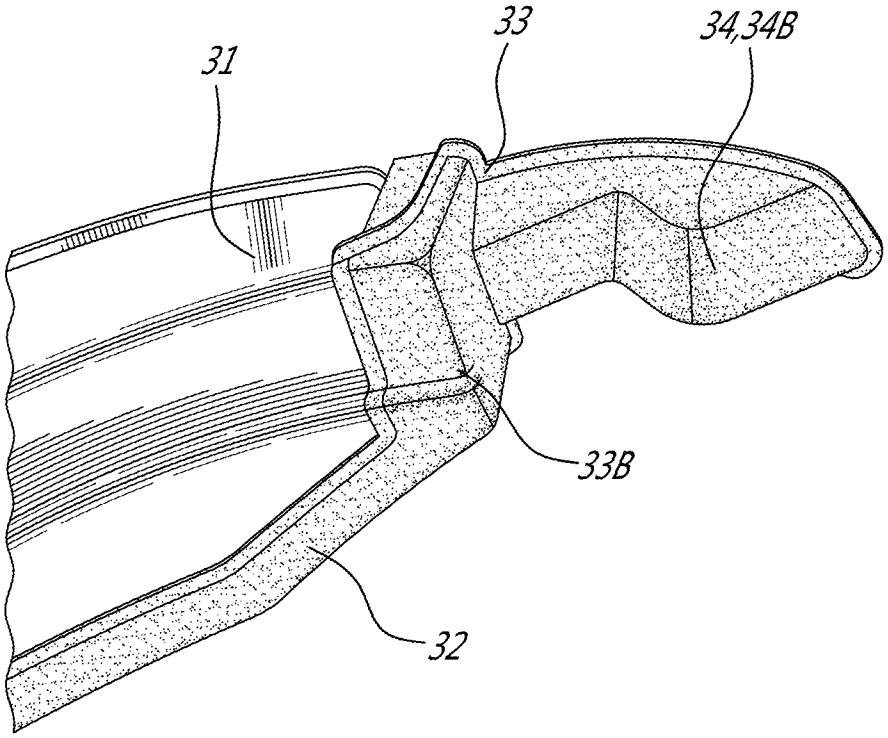
FIG. 2B is schematic tridimensional view of an end portion of the side protective member of FIG. 2A.

Referring to FIGS. 2A to 2C, an embodiment of one of the side protective members 30 is shown. Some or the entire side protective member 30 includes a rate sensitive foam 31. In the embodiment shown, the rate sensitive foam 31 is an inner portion of the side protective member 30, and is circumscribed by an outer side foam member 32 made of a different foam material. In a particular embodiment, the outer side foam member 32 is made of a foam material which is less rate sensitive than that of the inner portion 31.

The expression "rate sensitive" refers to foams that display different properties when exposed to different rates of strain. For example, compression rate sensitive foams may elastically compress or deform when exposed to lighter impacts, while stiffening up when exposed to harder impacts. Therefore, the foam "stiffens" when exposed to hard, sharp impacts. Conversely, the foam "gives" or yields when exposed to lighter impacts or smaller strain, and provides a cushioning effect. The rate sensitive foam 31 can be any suitable polymeric cellular material such as polyurethane "D30™" foam or any other foam material having similar properties. Other suitable polymeric foams include, but are not limited to, expanded polypropylene (EPP) foam, expanded polyethylene (EPE) foam, vinyl nitrile (VN) foam, polyurethane foam (e.g., PORON™) expanded polymeric microspheres (e.g., Expancel™), polyethylene, and ethylene-vinyl acetate (EVA).

Each side protective member 30 has one or more end portions 33. Each end portion 33 is a terminal or distal part of the side protective member 30, some or all of which engages with the inner layer. In the embodiment of FIGS. 2A to 2C, the side protective member has a forward, first end portion 33A, and an opposed rear, second end portion 33B. Each of the first and second end portions 33A, 33B has a protrusion 34 thereon. More particularly, the first end portion 33A has a forward protrusion 34A protruding along a thickness of the first end portion 33A (see FIG. 2C), and the second end portion 33B has a rear protrusion 34B protruding along a thickness of the second end portion 33B (see FIG. 2B). The protrusions 34A, 34B are positioned and sized to engage a corresponding recess in the inner layer, as explained in greater detail below. In this embodiment, both end portions 33A, 33B are disposed on the outer side foam member 32. Other configurations are also possible.

Figure 3A:
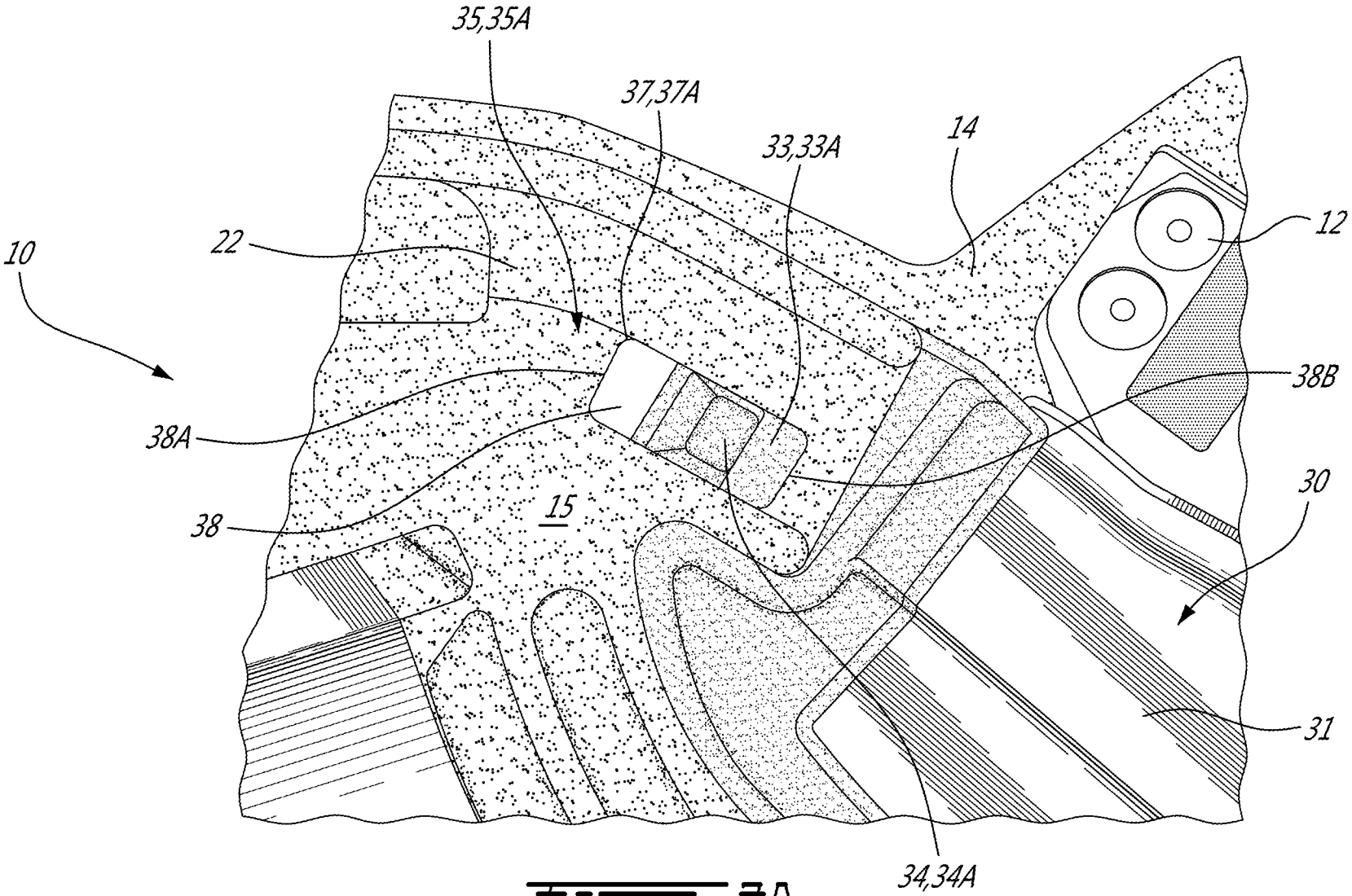
FIG. 3A is a schematic tridimensional view of a sliding connection of the helmet of FIG. 1A.
Figure 3C:
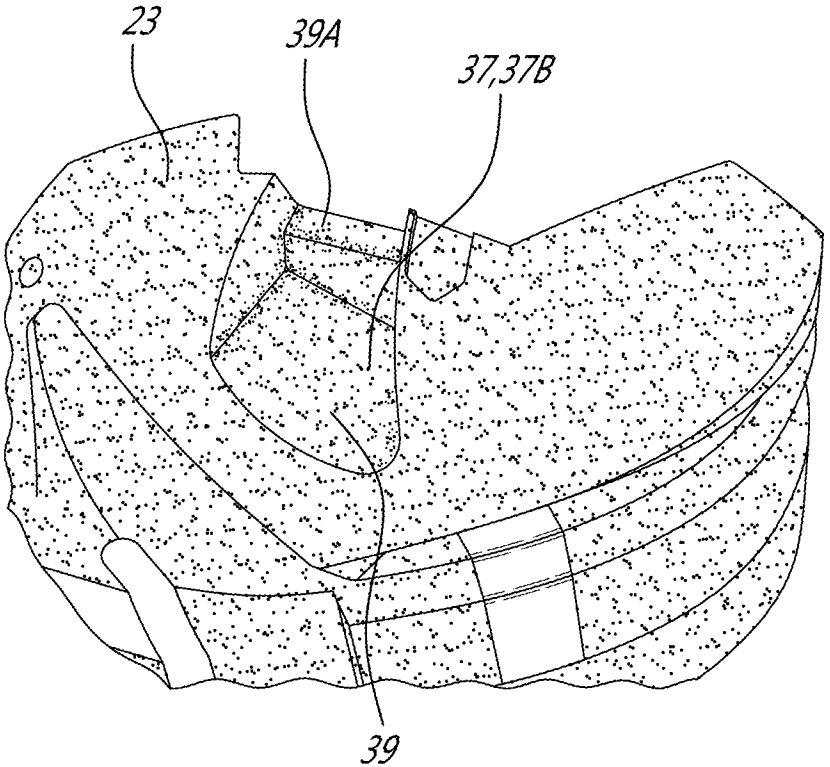
FIG. 3C is a schematic tridimensional view of a recess of the sliding connection of FIG. 3B.
Figure 3B:
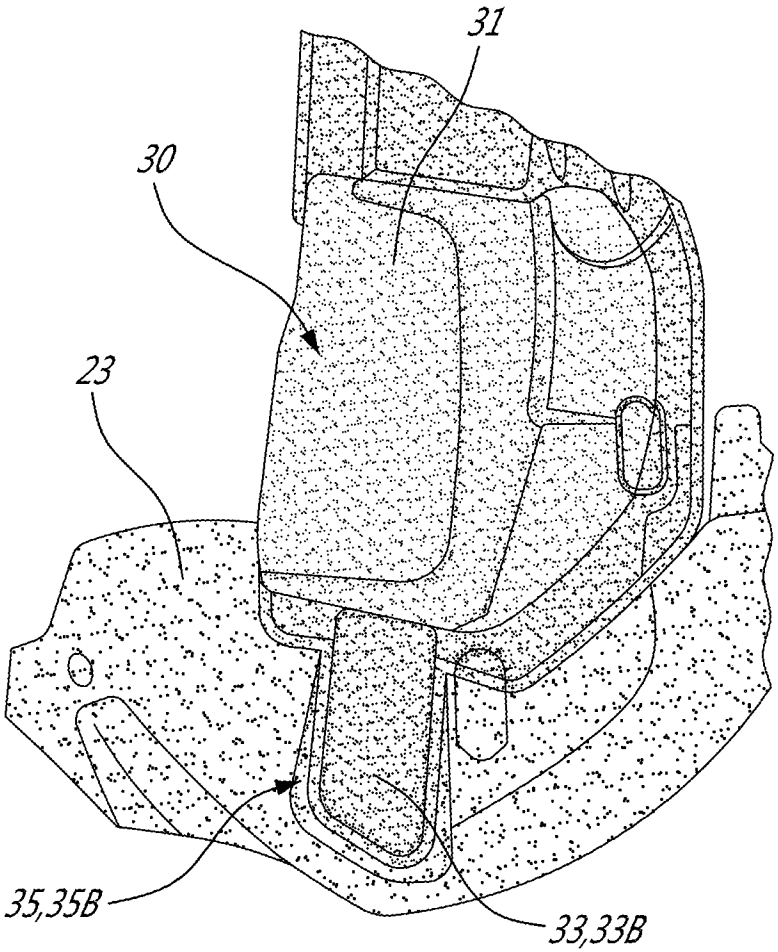
FIG. 3B is a schematic tridimensional view of another sliding connection of the helmet of FIG. 1A.

Referring to FIGS. 3A to 3C, the end portions 33 extend between a corresponding one of the first and second layer sections 22, 23, and a corresponding one of the first or second shell section 12, 13. In the embodiment shown, the first end portion 33A extends between the first layer section 22 and the first shell section 12 (FIG. 3A) and the second end portion 33B extends between the second layer section 23 and the second shell section (FIGS. 3B and 3C, the second shell section not being shown). The two end portions 33 are each displaceable relative to the corresponding layer section 22, 23 when the size of the internal enclosure 15 is adjusted.

The relative displacement of the end portions 33 of each side protective member 30 with respect to a corresponding layer section 22, 23 allows both shell portions 12, 13 to move with respect to the side protective members 30. In a particular embodiment, this allows for the side protective members 30 to remain in a fixed position relative to the portion of the head for which they provide protection. The side protective members 30 may therefore remain in the same position, irrespective of the size of the internal enclosure 15.

In the embodiment shown, a sliding connection 35 is defined at each end of the side protective members 30 to allow the relative displacement described above. More particularly, in this embodiment, the sliding connection 35 is formed between the end portions 33 of each side protective member 30 and the corresponding first and second layer sections 22, 23.

The sliding connection 35 is defined by each protrusion 34 which engages, and is received in, a corresponding recess 37. The protrusion 34 and the recess 37 are slidingly displaceable relative to one another. In the embodiment of FIGS. 3A to 3C, the protrusions 34 are disposed on each side protective member 30, and the recess 37 is defined in the corresponding first or second layer section 22, 23. In the embodiment shown, a first sliding connection 35A includes the forward protrusion 34A disposed on the forward first end portion 33A, and a second sliding connection 35B includes the rear protrusion 34B (hidden from view in FIG. 3B) disposed on the rear second end portion 33B. The first sliding connection 35A also has a forward recess 37A in the first layer section 22 for receiving the forward protrusion 34A therein, and the second sliding connection 35B has a rear recess 37B in the second layer section 23 for receiving the rear protrusion 34B therein. As shown in FIG. 3A, the forward recess 37A may take the form of an elongated aperture 38 or hole defined completely through the thickness of the first layer section 22, with the elongated aperture 38 extending between two opposed extremities 38A, 38B. The rear recess 37B, as shown in FIG. 3B, may take the form of an elongated groove 39 defined through only part of a thickness of the second layer section 23, that has a groove wall 39A which is located at a forward extremity of the groove 39. Other configurations are also possible.

The aperture 38 and the groove 39 define a limited path of relative movement for limiting the sliding displacement of the protrusions 34, and thus, of the side protective member 30. For example, and as shown in FIG. 3A, the opposed extremities 38A, 38B of the aperture 38 define the maximum extent of sliding displacement such that the forward protrusion 34A disposed in the aperture 38 is prevented from displacing past either one of the extremities 38A, 38B. Similarly, and as shown in FIGS. 3B and 3C, the groove wall 39A of the groove 39 abuts against the rear protrusion 34B and limits its forward displacement.

It can thus be appreciated that in the configurations shown in FIGS. 3A to 3B, both the first and second end portions 33A, 33B slidingly engage the inner layer at the respective first and second layers 22, 23. Each side protective member 30 is thus engaged only with the inner layer 20 via the corresponding sliding connections 35, and is therefore not attached to the outer shell 11. Each side protective member 30 is therefore displaceable relative to the outer shell 11 and its first and second shell sections 12, 13, in addition to being displaceable relative to the inner layer 20.

Although the protrusions 34 are shown as being a component of the side protective member 30, and although the recesses 37 are shown as being defined in the first and second layer sections 22, 23, it will be appreciated that the opposite configuration is also within the scope of the present disclosure. More particularly, the protrusions 34 may be components of the first and second layer sections 22, 23, and the recesses 37 may be defined in the side protective member 30.

Similarly, although both end portions 33 of each side protective member 30 are shown as being slidingly displaceable relative to the corresponding first and second layer sections 22, 23, it is understood that alternately each side protective member 30 may be engaged to the layer sections 22, 23 such as to be slidable with respect with only one of the layer sections 22, 23.

In addition or alternately, the side protective members 30 may be engaged to the helmet sections using any other type of suitable engagement to the layer sections 22, 23 and/or the outer shell sections 12, 13. As a non-limiting example, the end portions 33 may extend and be engaged inside the layer sections 22, 23 instead of extending between the layer sections 22, 23 and outer shell section 12, 13.

It is also understood that protective members other than side protective members could be similarly engaged to helmet sections, depending on the particular configuration of the helmet, including, but not limited to, top protective members positioned to overlay a top of the head, and rear protective members positioned to overlay a back of the head.

The above description is meant to be exemplary only, and one skilled in the art will recognize that changes may be made to the embodiments described without departing from the scope of the invention disclosed. Still other modifications which fall within the scope of the present invention will be apparent to those skilled in the art, in light of a review of this disclosure, and such modifications are intended to fall within the appended claims.

The invention claimed is:

1. A protective helmet adapted to protect a head of a wearer, the protective helmet comprising:

first and second helmet sections each including an outer shell section and an inner layer section of protective material mounted to the respective outer shell section, the first and second helmet sections being displaceable relative to one another to adjust a size of the helmet;

two opposed side protective members received inwardly of the outer shell sections on opposed sides of the helmet, each of the side protective members having a first end portion and an opposed second end portion, the first end portion engaged with the first helmet section, the second end portion engaged with the second helmet section; and means for adjusting a position of the side protective members relative to the inner layer sections of protective material, said means disposed at least in part between the outer shell sections and the inner layer sections and configured such that, when the protective helmet is adjusted when on the head of the wearer, the protective members remain substantially stationary with respect to the head of the wearer when the inner layer sections are displaced with the first and second helmet sections.

2. The protective helmet of claim 1, wherein the means for adjusting a position of the side protective members includes a sliding connection defined between the first end portion of the protective member and one of the inner layer sections of protective material, the sliding connection including a recess and a protrusion received by the recess for sliding displacement relative to one another, the sliding connection providing relative displacement between the side protective member and said inner layer section.

3. The protective helmet of claim 2, wherein the recess includes an elongated aperture that defines a path along which the protrusion slides from one end of the elongated aperture to the other, the recess defined in one of the first end portion of the side protective member and the inner layer section.

4. The protective helmet of claim 3, wherein the protrusion extends from the other of the first end portion of the side protective member and the inner layer section, the protrusion being received within the elongated aperture and slidingly displaceable therewithin along the path.

5. The protective helmet of claim 1, wherein each side protective member is displaceable relative to the outer shell sections and relative to the inner layer sections of protective material.

6. The protective helmet of claim 1, wherein the means for adjusting a position of the side protective members defines a limited path of relative movement between the side protective members and the inner layer sections.

7. The protective helmet of claim 1, wherein the side protective members are unattached to the outer shell sections.

8. The protective helmet of claim 1, wherein the side protective members include a foam material.

9. The protective helmet of claim 1, wherein each of the side protective members include an outer foam member circumscribing an inner foam member, the outer and inner foam members being made of different foam materials.

10. The protective helmet of claim 9, wherein the inner foam member comprises a rate sensitive foam.

11. The protective helmet of claim 1, comprising a top protective member configured to overlay a top of the head of the wearer.

* * * * *